US005832941A

United States Patent [19]

Murillo

[11] Patent Number: 5,832,941

[45] Date of Patent: Nov. 10, 1998

[54] LIT KIT

[76] Inventor: Laura Gwynn Lessig Murillo, 1605 W. Sunrise Mountain Rd., Fayetteville, Ark. 72701

[21] Appl. No.: 867,865

[22] Filed: Jun. 3, 1997

[51] Int. Cl.[6] ..... A45D 42/00

[52] U.S. Cl. ..... 132/316; 132/294; 132/296; 132/301; 206/5.1; 206/38

[58] Field of Search ..... 132/294, 293, 132/296, 301, 316; 206/581, 823, 5.1, 459.1, 38, 235; 116/308, 307, 280; 220/235

[56] References Cited

U.S. PATENT DOCUMENTS 2,761,458 9/1956 Werber ..... 206/235
4,574,944 3/1986 Gregory ..... 206/5.1
4,909,382 3/1990 Cuppari ..... 132/294
5,358,100 10/1994 Wolff ..... 206/823

*Primary Examiner*—John J. Wilson
*Assistant Examiner*—Pedro Philogene
*Attorney, Agent, or Firm*—Patent & Trademark Services; Thomas Zack; Joseph H. McGlynn

[57] ABSTRACT

A portable compact kit having compartments for make-up and beauty supplies and a mirrored surface with a peripheral light source powered by a rechargeable battery power source. The unit's power pack may either be included within a tray mounting the mirror or within the body of the kit. As an option, inputted alternating current power may be switched to bypass the battery and be supplied directly for household current to light the mirror's light source.

6 Claims, 1 Drawing Sheet

LIT KIT

BACKGROUND OF THE INVENTION

Portable compact make-up kits have been used to help users in the application of make-up and other beauty supplies. The convenience of such kits when in limited space living conditions and when traveling have added to their commercial success. Some kits come with built-in viewing mirrors in assist in the process. Using the mirror for its intended purpose, however, may be limited by the available ambient lighting conditions. Examples include, hotels and motels having insufficient background lighting to adequately permit the mirror to be used as intended. The present invention seeks to provide a solution to this deficiency and other related problems by providing for a portable compact make-up and beauty supply kit having a mirror and various components for make-up and associated beauty supplies and a rechargeable self-contained power source to power a light source for viewing a mirror as detailed herein.

DESCRIPTION OF THE PRIOR ART

Compact make-up or vanity cases have been used for years and come in a variety of shapes and sizes with different carried articles and items. For example, in U.S. Pat. No. 5,025,817 to Wen a spherical vanity case is disclosed having a pivoted mirror, a space for small toiletries, a compartment for holding dusting powder and rouge cake and bottom slots for receiving a powder make-up case. Moving an intermediate section causes the powder make-up cases to slide in or out of their slots.

Other make-up or cosmetic kits, such as described in U.S. Pat. No. 5,092,354 to Pacelli Jr., has several releasable receptacles or godets which can be replaced with other units having different user needs. A resilient element on the godets engages a ledge in the unit's base to permit its removal and insertion of a different godets with different dimensions. A mirror may be used in the units closable cover.

In the beauty kit disclosed in the Chang invention (U.S. Pat. No. 5,513,754), various compartments containing different components are interrelated and joined into one unit with a hinged mirrored cover. And in U.S. Pat. No. 5,226,541 to Huang a multi-functional knock-down type of make-up kit is disclosed having cooperating male and female slip joints. The present invention has many of the advantages and conveniences of these prior art kits by providing for a portable unit have compartments for make-up and beauty supplies with a lighted mirror having its own rechargeable power source in the kit as more further set forth in this specification.

SUMMARY OF THE INVENTION

This invention relates to a portable compact kit having compartments and a mirrored surface with a light source powered by a rechargeable power source. The unit's power pack may either be included within the unit's tray mounting the mirror or be kept within the kit. As an option, inputted alternating power to the battery may be switched to be supplied directly to the mirror's light source.

It is the primary object of the present invention to provide for an improved makeup kit with a lighted mirror.

Another object is to provide for such a kit wherein the power source for the light is rechargeable.

These and other objects and advantages of the present invention will become apparent to readers from a consideration of the ensuing description and the accompanying drawings.

DESCRIPTION OF THE PREFERRED EMBODIMENT

Figure 1:
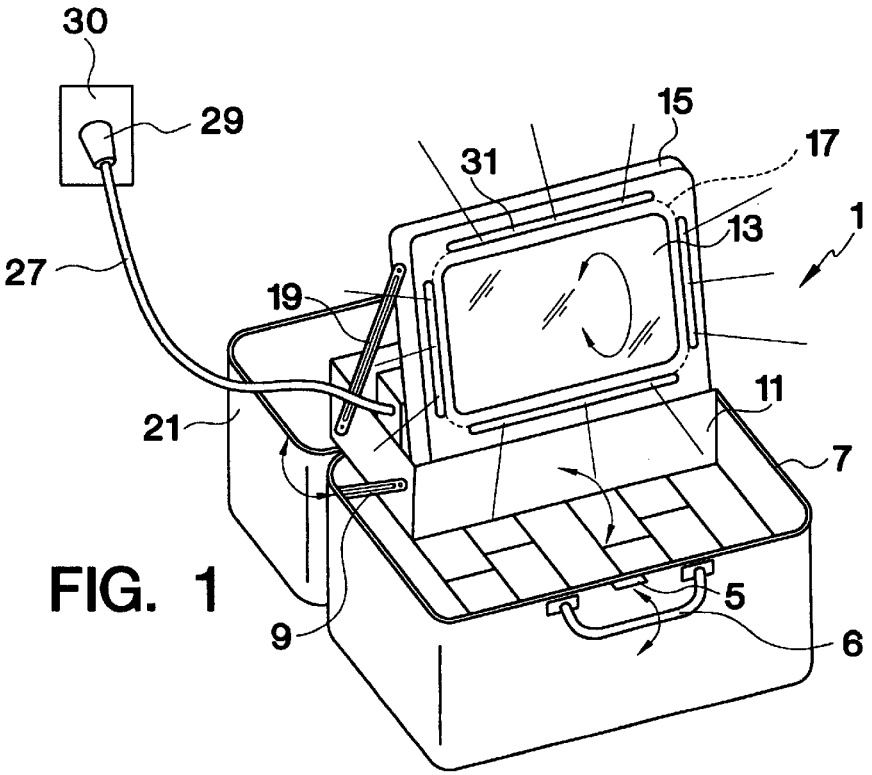
FIG. 1 is a front perspective view of the invention's preferred embodiment.

FIG. 1 is a front perspective view of the invention's preferred embodiment. A compact lightweight kit 1 similar to a small suit case having two hollow halves joined at their adjoining edges by hinges 3. These halves are used to store and transport make-up and beauty supplies. Each half of the kit 1 is substantially identical in size and shape such that when folded together at their unhinged free edges (see direction of the arrows) they form one single unit which may be locked together by the front lock/latch kit mechanism 5.

An external front attached carrying handle 6 may be used to transport the folded kit unit. Located near the rear hinges of kit half 7 having front lock mechanism 5 are two spaced collapsible pivot legs 9. These legs interconnect the lower kit half 7 to the foldable upper rectangular tray 11 and are mounted on each of its two opposite sides.

Tray 11 pivotally mounts a lighted mirror 13 having above it an internal light source or sources which extend around the mirror's periphery edge band 15 on all sides. This mirror may be a conventional rotatable side mounted two sided mirror wherein one side provides a normal sized reflected view while the other side, upon the mirror's rotation, provides for a magnified reflected view. The light source or sources are located behind a translucent peripheral lens 17 which is coextensive with the peripheral edge band 15 to emit light totally around the exposed mirrored surface 13. With either mirrored side exposed, the mirror 13 with its lighted peripheral band may be folded down into the body of the tray 11 by pushing it and its light source backwards on the mirror's two side legs 9.

The rear half 21 of kit 1 has sufficient space to accommodate the mirror 13 and its holding tray 11 when folded into it. Cushioned surfaces 23 in this rear half 21 engage the tray's bottom when folded down to protect the mirror in the tray. Also located in the tray 11 are compartments for a rechargeable power pack 25 and its attached power cord 27 whose plug end has a three prong safety plug 29. This plug is shown plugged into a typical alternating current household wall socket 30 to recharge the power pack 25. The power pack 25 is internally connected to the mirror's internal light source 31 which extends around the mirror behind its lens 17. As is conventional, this pack has its own internal transformer to convert the charging alternating current input to direct current which then recharges the rechargeable battery. The mirror's light source 31 can take on a variety of conventional forms such as sixteen small spaced incandescent light bulbs of about 3 watts each, four of which are located on each of the peripheral sides; or four spaced fluorescent straight light sticks with one stick being located on each side of the four mirror sides.

Low wattage halogen bulbs may also be used in place of conventional incandescent bulbs to supply greater intensity light (more lumens) if desired. The connected power pack 25 with its own rechargeable battery and is of conventional design and may be purchased as an "off the self" component from an electronics supplier. As an option, the user may run the light source directly from the connected alternating current power source and bypass the batteries in power pack 25 by actuating a switch 32 which in on the pack's side (see FIG. 2). Switch 32 when actuated, connects and switches to the packs internal circuit transformer, which is supplying changed alternating current to direct current, to supply the same direct current (DC) current to the light source without going through the battery recharging circuitry.

Appropriate on/off or dimmer switches 34, internally connected to the power source, may be used to control the supply of power to the mirror's light source 31. If desired, the switch can be set to be actuated only when the normally folded mirror is elevated to a usable position, as shown in FIG.1, and cut off when folded down into a non-use storage position in the tray 11. All such switches and their circuits are conventional and further explanation as to their particular configuration is believed unnecessary.

Figure 2:
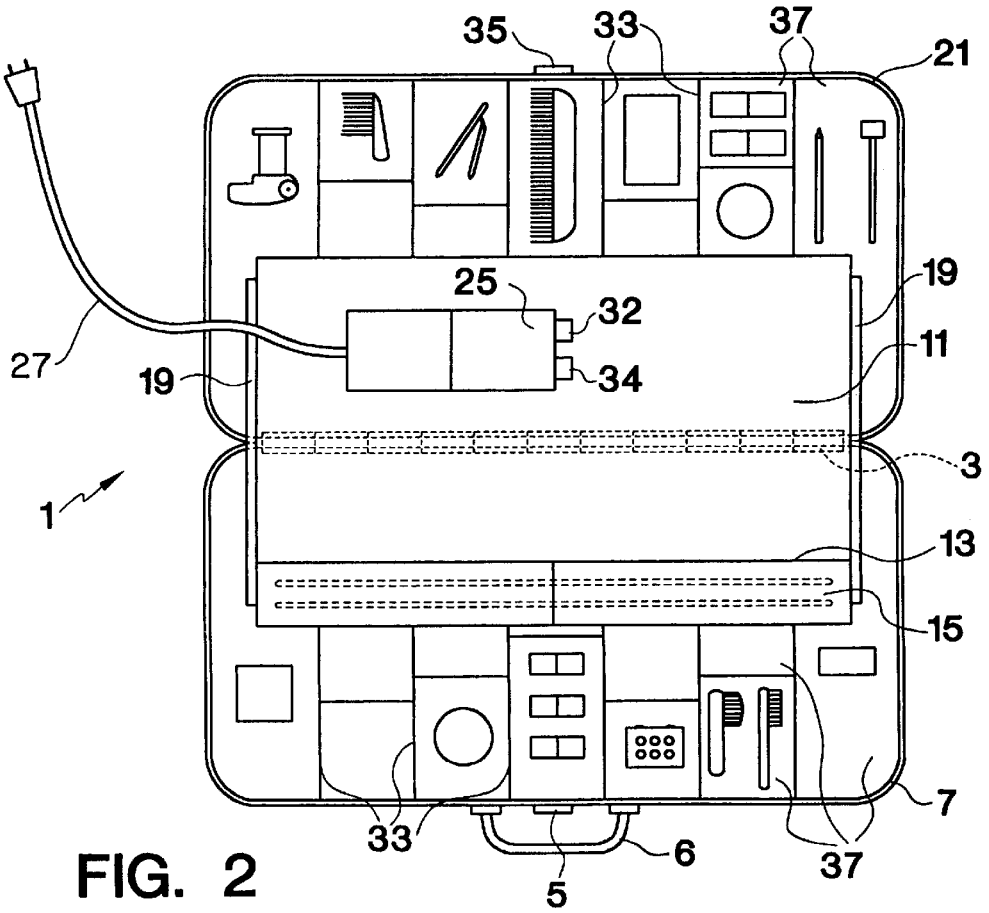
FIG. 2 is a top view of the FIG. 1 embodiment.

FIG. 2 is a top view of the FIG. 1 embodiment and shows most of the components previously mentioned. Located within the front kit's half 7 are several compartments 37 of different sizes separated by partition walls 33 used to store personal grooming items such as make-up and beauty supplies. This includes items such as face powders, rouge, lipstick, tweezers, a nail cutter and files, nail polish, combs, hair brushes hair blowers, etc. The particular personal grooming items stored are only limited by their size and shape relative to the size and shape of the compartments 37.

The kit 1 may be made of a molded plastic material that is lightweight, strong and resistant to moisture. The plastic injection molded process can be used for this purpose. The conventional lock/latch mechanism 5 may have a metal lock that engages a locking member 35 on the rear kit's half 21 when folded down. The kit's U-shaped carrying handle 6 can be pivotally connected to the kit's front side. Either a key or combination may be used to unlock the lock of mechanism 5.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A portable compact storage and carrying kit for make-up and beauty supplies comprising:

a hollow kit having two joined halves substantially of the same size and shape which can be folded to each other to form a single closed portable unit, at least one of said halves having compartments for storing items relating to personal grooming;

an upper tray mounted to said kit and adapted to be folded down into hollow part of the kit;

a lighted mirror mounted on said tray, said mirror having its own light source which emits lights around the mirror's periphery; and a rechargeable power source for supplying power to said mirror's light source, said power source being operatively connectable to said light source and enclosed in the folded kit unit.

2. The invention as claimed in claim 1, wherein said lighted mirror is mounted to the tray by pivotally connected leg members extending from sides of the tray to the sides of the mirror.

3. The invention as claimed in claim 2, wherein said tray is pivotally connected by leg members extending from sides of the tray to the sides of the kit.

4. The invention as claimed in claim 3, also including an external kit carrying handle located on one of the kit's halves; and a latch and lock mechanism to lock both kit halves together when folded on each other.

5. The invention as claimed in claim 4, also including switch means to switch the supply of inputted power from the rechargeable power source and permit the direct supply of power from an external source to the mirror's light source.

6. The invention as claimed in claim 2, wherein said mirror has two opposite sided mirrored surfaces, one of said mirrored surfaces providing an enlarged magnified reflected viewed when compared to the reflected view of the other mirror's side.

* * * * *